United States Patent [19]

Palmer

[11] 3,943,909

[45] Mar. 16, 1976

[54] OIL COOLING SYSTEM

[76] Inventor: Howard J. Palmer, 68 Gaywood Place, Moraga, Calif. 94556

[22] Filed: Apr. 26, 1974

[21] Appl. No.: 464,647

[52] U.S. Cl. ..... 123/196 AB; 184/104 B

[51] Int. Cl.[2] ..... F01M 5/00

[58] Field of Search ..... 137/561 R; 123/196 AB; 184/104 B

[56] References Cited

UNITED STATES PATENTS

| | | | |
|---|---|---|---|
| 1,776,726 | 9/1930 | Gross | 184/104 B |
| 1,846,268 | 2/1932 | McCuen | 123/196 AB |
| 1,976,772 | 10/1934 | Clarke | 123/196 AB |
| 2,070,092 | 2/1937 | Ramsaur | 123/196 AB |
| 2,691,972 | 10/1954 | Stump et al. | 123/196 AB |
| 2,788,176 | 4/1957 | Andersen | 123/196 AB |
| 2,966,164 | 12/1960 | Britton | 137/561 R |
| 3,465,847 | 9/1969 | Donath et al. | 123/196 AB X |

FOREIGN PATENTS OR APPLICATIONS

| | | | |
|---|---|---|---|
| 450,601 | 8/1948 | Canada | 123/196 AB |
| 855,388 | 5/1940 | France | 123/196 AB |

*Primary Examiner*—Charles J. Myhre
*Assistant Examiner*—William C. Anderson
*Attorney, Agent, or Firm*—Harris Zimmerman

[57] ABSTRACT

An improved oil cooling system for internal combustion engines includes a pressure relief block which replaces the standard oil cooler of the engine, and a finned radiator depending from the engine sump plate in the passing air stream. The oil is pumped through the engine to the pressure relief block, where it passes a high pressure relief valve and is diverted through the hoses to the finned radiator. The cooled oil leaves the radiator, passes through a low pressure relief valve, and returns to the sump. The entire system may be bolted onto an existing engine with no modification to the engine required, to provide greatly increased oil cooling capacity. Further, the entire or substantially the entire oil flow must pass through the cooling system prior to passage through any pressure relief valves or the like.

8 Claims, 6 Drawing Figures

OIL COOLING SYSTEM

BACKGROUND OF THE INVENTION

A common form of internal combustion engine is the air-cooled reciprocating engine with horizontally opposed cylinders. These engines were designed to be long-lived, low horsepower devices that could be easily serviced and maintained. Over the span of several decades, as the amount of freeway driving increased markedly, the greater average velocity of auto travel demanded a corresponding increase in engine horsepower output. To satisfy this demand, these aircooled engines were provided with greater cylinder displacements, while the engine block and ancillary parts remained relatively unchanged.

Axiomatically, an increase in power output is accompanied by an increase in heat generated in the engine. An important aspect of the cooling system is the oil cooler, which provides cool oil to moving parts which undergo the highest wear and generate the most heat. Although the air cooling system has proven to be sufficient to cool the cylinders and the engine block, it has been found, through many unfortunate engine breakdowns, that the oil cooling system cannot support the increased power of the engine. That is, the oil cooling radiator within the air shroud of the engine radiates so much heat that the nearby engine parts are not adequately cooled. Thus, a common occurrence is that nearby valves or bearings heat up and burn out, causing sudden, disasterous breakdowns which are expensive to repair.

Although a larger capacity, original equipment oil cooler designed to accommodate the modern engine prior output would obviously solve this problem, such a cooler has not been forthcoming from the manufacturers for many years. Millions of engines now in operation are subject to such breakdown, and are in need of modification. One such modification attempted in the prior art involved the diverting of a portion of the oil flow into an additional oil cooling radiator disposed in the cooling-air stream. These devices failed partly due to the fact that the additional radiator heated the airstream so that the engine as a whole was overheating.

SUMMARY OF THE INVENTION

The present invention provides an improved oil cooling system which sufficiently cools the entire oil flow of an internal combustion engine without adversely affecting the air cooling of the engine itself, and which is easily installed on existing engines without expensive or complicated procedures. The system includes an external oil cooling radiator which depends from the sump plate of the engine and which includes a central opening therethrough so that access to the oil sump itself is maintained. The radiator is fed through hoses which connect to a pressure relief block bolted to the engine in place of the original oil cooling radiator within the air cooling shroud.

The pressure relief block comprises a solid rectangular metal block with a plurality of apertures therethrough disposed to align with the existing holes and studs of the engine to facilitate bolting the pressure relief block directly to the engine. Passages drilled into the block define a pressure relief valve cavity, and channels which conduct the oil flow to the relief valve and thence to hose connections formed in the pressure relief block.

The system of the present invention is arranged so that oil is drawn from the sump by the existing oil pump, and forced under pressure to the pressure relief block. There the oil is diverted to different paths, according to engine conditions. Either the oil flows through the relief valve directly to the lubricating points in the engine, or past the relief valve, through hoses to the oil cooler and return, and thence to the lubricating points. The external oil cooling radiator provides greater heat exchanging capacity than the original equipment cooler and, due to its placement outside of the engine air cooling stream, does not diminish the cooling of other portions of the engine. It is most significant to note that in the present invention, the pressure relief valve is positioned downstream of the radiator so that the bulk of the engine oil will be required to pass through the cooler.

THE DRAWING

Flg. 6 is a cross-sectional view of the oil cooling radiator of the present invention.

DESCRIPTION OF THE PREFERRED EMBODIMENT

The present invention generally comprises an improved oil cooling system which is used to modify an air cooled engine to provide increased heat exchanging capacity in the oil system. This improved system allows the engine to be operated continuously at high power levels without excessive wear. Further, the invention may be secured to an existing engine using ordinary mechanical skill and common tools, with no appreciable weight added to the engine.

Figure 1:
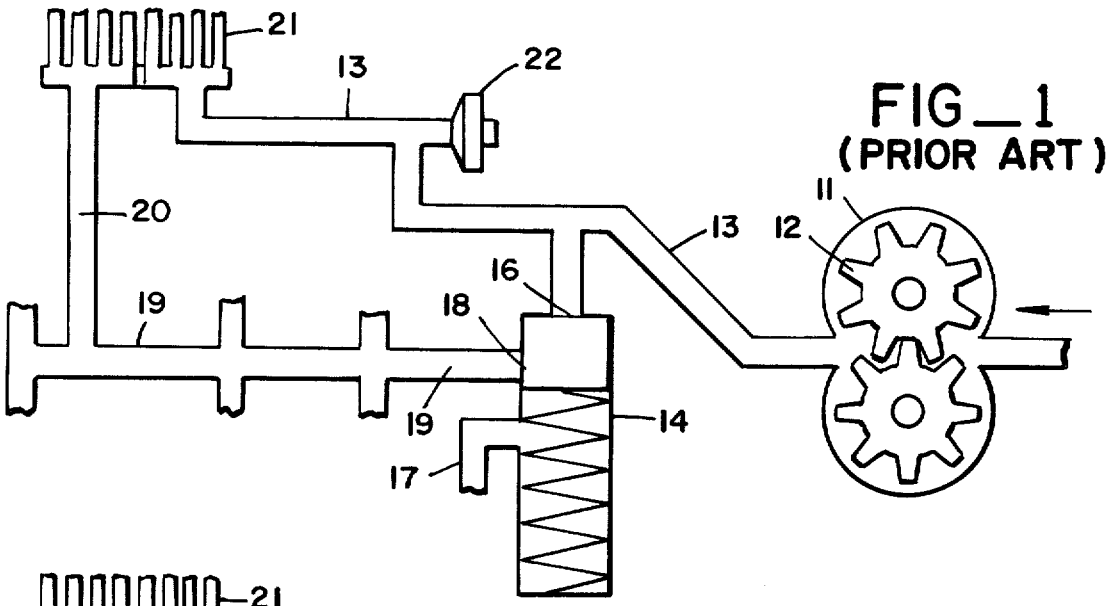
FIG 1 (PRIOR ART)
FIG. 1 is a schematic view of the existing lubricating system with the pressure relief valve closed.
Figure 2:
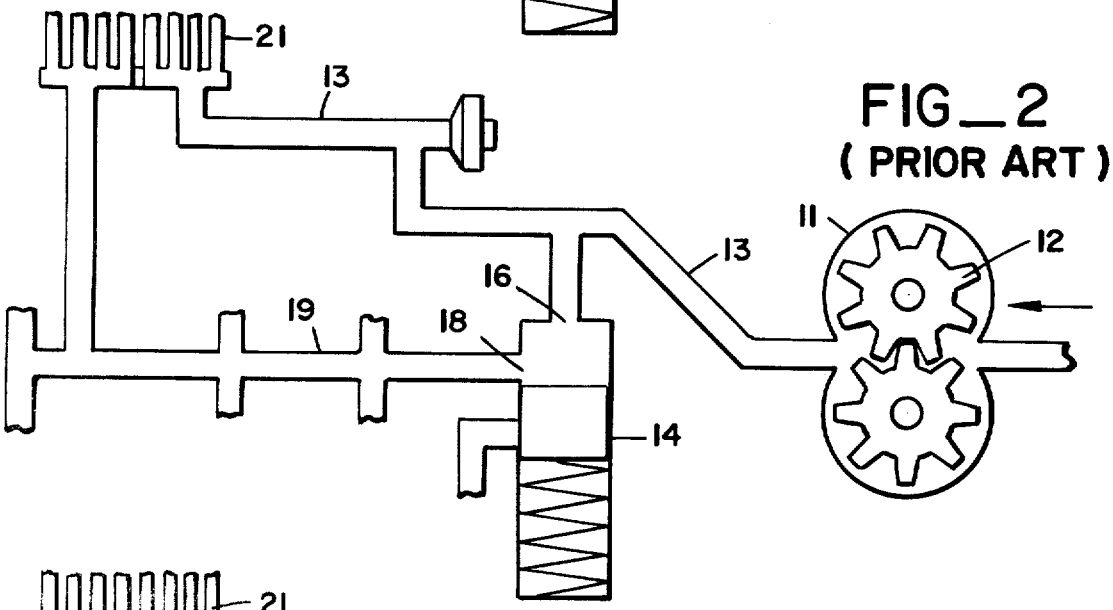
FIG 2 (PRIOR ART)
FIG. 2 is a schematic view of the existing lubricating system with the pressure relief valve partially open.
Figure 3:
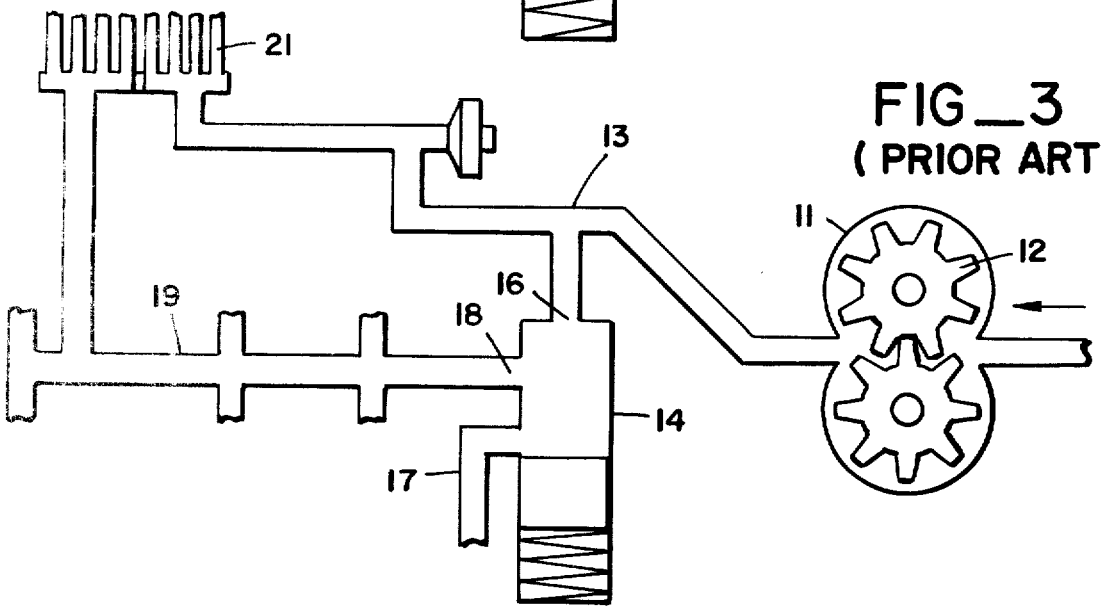
FIG 3 (PRIOR ART)
FIG. 3 is a schematic representation of the existing lubricating system with the pressure relief valve fully open.

As shown in FIGS. 1 through 3, the existing lubricating system typically includes an oil pump 11, which is provided with spur gears 12 driven by the camshaft. The spur gears cooperate to draw lubricating oil from the oil sump and pump it through passage 13. The existing oil system also includes a pressure-relief valve 14, which has a low pressure port 16 communicating with passage 13. The valve 14 also is provided with a high pressure port 17 which leads to the oil sump, and a mid-pressure port 18. The port 18 leads to passage 19 which conducts oil to the moving parts requiring lubrication. The system is also furnished with an oil cooling radiator 21 connected between passage 13 and passage 19 by passage 20, and a pressure sensing switch 22 communicating with passage 13. The radiator 21 is secured to the engine within the air cooling shroud.

During engine starting and initial warm up, the lubricating oil is cold and viscous, causing high oil pressure in the lubricating system. As depicted in FIG. 3, the high pressure forces the valve 14 fully open, so that all ports 16 – 18 are open. In this state, most of the oil flows through port 17 back to the sump, while a portion of the oil flows through port 18 to lubricate the moving parts, thence falling back to the sump. Little of the oil passes through passage 13 to the oil cooling radiator.

As the engine warms, the oil viscosity and therefore the oil pressure subsides. In this condition, depicted in FIG. 2, the pressure relief valve is partly open, so that port 16 and port 18 are in open connection. The oil is free to flow either through passage 13 to the radiator 21 and thence to passage 19 to lubricating points, or through ports 16 and 18 of the valve 14 directly to passage 19 and the lubricating points. As the engine attains operating temperatures, the decreased oil pressure of less than approximately 40 lbs/in$^2$ cannot operate the pressure relief valve 14 at all. Thus all of the hot oil is pumped through passage 13, cooled in the radiator 21 and thence goes to the lubricating points of passage 19.

As described in the foregoing, the radiator 21 has insufficient heat exchanging capacity due to its placement within the air cooling shroud, and to its size. The obvious solution, i.e., replacing the radiator 21 with a larger external radiator, is equally unsatisfactory. When the engine is warming up, an external radiator contains therein cold, viscous oil which will flow only under high pressure. As evident from FIG. 3, this high pressure is diverted directly to the lubricating passage 19 until the engine and the radiator warm. Even after warming of the oil there is not sufficient pressure or flow to perform satisfactorily.

Figure 4:
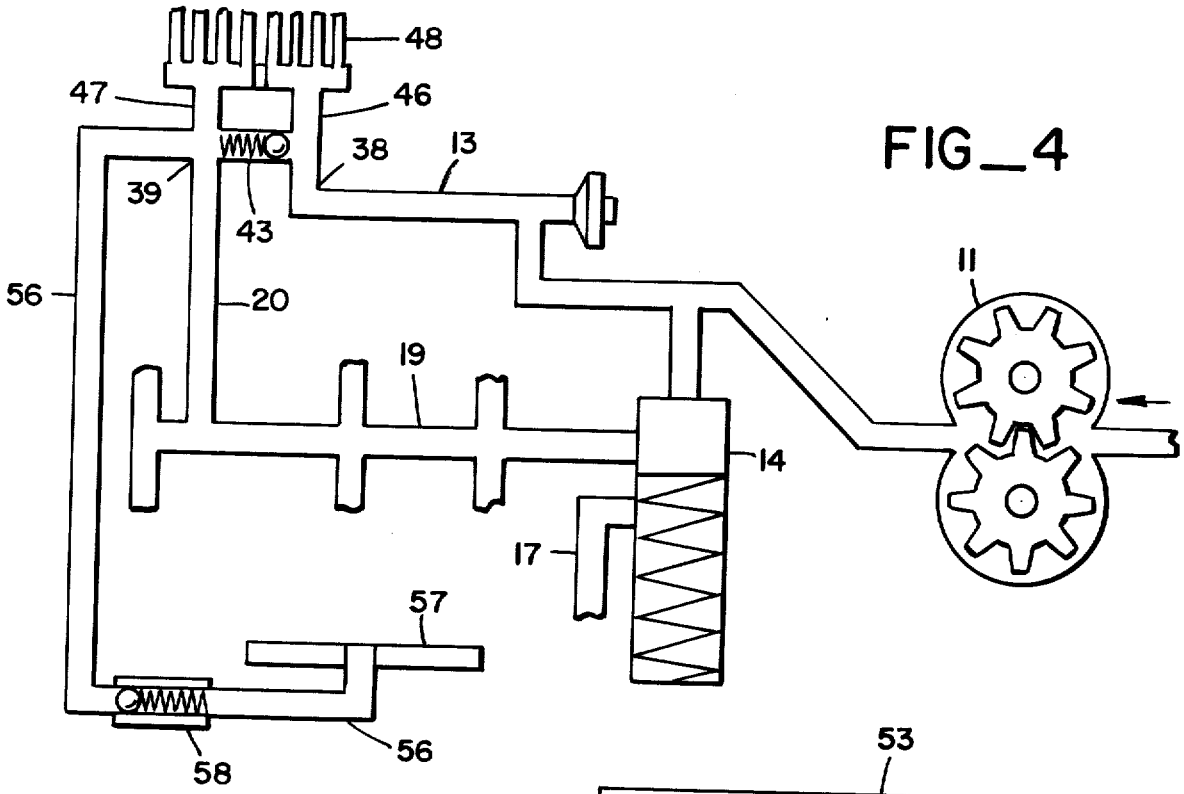
FIG. 4 is a schematic depiction of the oil cooling system of the present invention.

The improved lubricating system of the present invention provides an effective solution to the problems elucidated in the foregoing. As shown in FIG. 4, the invention utilizes the pump 11, the pressure relief valve 14, the passage 13 and the lubricating passage 19 of the existing engine. In the valve 14, the spring 26 is replaced with a less resilient one that provides pressure relief at approximately 100 lbs/in$^2$.

Figure 5:
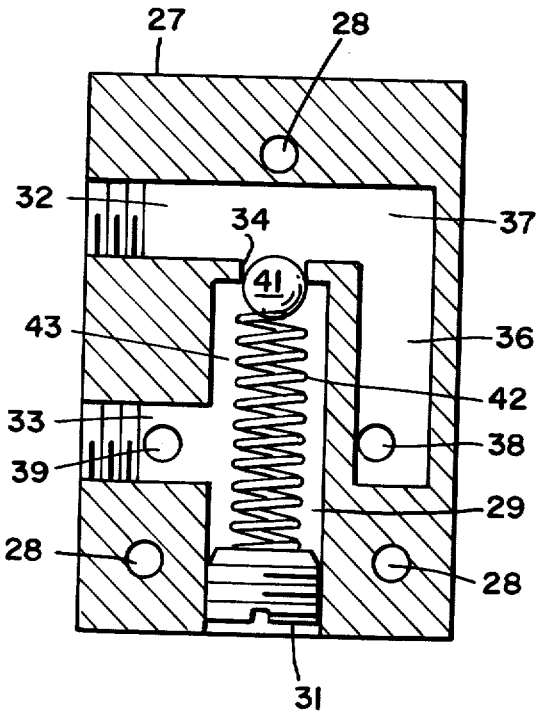
FIG. 5 is a cross-sectional view of the pressure relief valve of the present invention.

In the present invention the existing radiator 21 is removed, and in its place is installed a pressure relief block 27. The block 27, as shown in FIG. 5, comprises a rectanular metal solid with holes 28 therethrough to receive the mounting bolts and studs which originally mounted on the radiator 21. A central passage 29 extending into the block 27 is threaded at the outer end to receive a threaded plug 31 which seals the passage. Perpendicular to the passage 29 and extending into the block are a pair of passages 32 and 33. The shorter passage 33 opens into the middle of the passage 29, while the longer passage 32 communicates with the passage 29 through the reduced diameter hole 34 at the inner end thereof. Both passages 32 and 33 are provided with threaded outer ends to receive hoses carrying oil under pressure.

Also within the block 27 is a passage 36 extending from the inner end 37 of the passage 32 and parallel to the passage 29. The block is furnished with a port 38 opening into the passage 36, and a port 39 opening into passage 33. The ports 38 and 39 align and seal with holes in the engine block originally provided to conduct oil to and from the radiator 21. A metal ball 41 seals the holes 34 under the resilient urging of compressed spring 42, forming a pressure relief valve 43 which is opened by high pressure oil (approximately 75 lbs/in$^2$) within passage 32, conducting the oil into passage 33 and relieving the high pressure. It might be noted that, if desired, the pressure relief valve 43 may be positioned exteriorly of the block 27.

Figure 6:
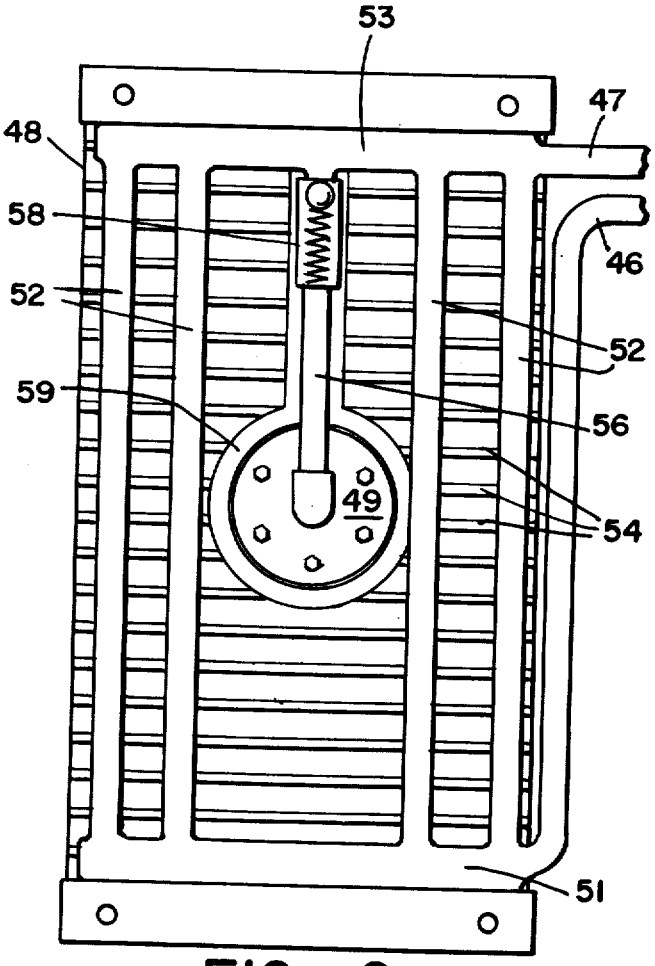

With the block 27 bolted to the engine hoses 46 and 47 are secured to the threaded portions of passages 32 and 33 respectively. These hoses 46 and 47 respectively comprise the input line to, and the output line from, the external radiator 48. As shown in FIG. 6, the raditor 48 is bolted to the underside of the engine, in the stream of air passing the moving vehicle. The radiator includes a supply header 51 which feeds oil from line 46 through a rank of parallel cooling pipes 52 to a return header 53, and a plurality of cooling vanes 54 linking the cooling pipes.

The return header is joined to line 47, and is also joined to a tube 56 leading to the oil sump 57. Interposed in the tube 56 is a pressure relief valve 58, which typically opens at 40 lbs/in$^2$. It should be noted that the vanes 54 are discontinuous near a sump plate 49, forming an aperture 59 through the radiator to permit access to the sump plate.

The improved lubricating system of the present invention functions in a manner different from the original system. With reference to FIG. 4, oil is pumped by the pump 11 from the sump 57 into passage 13. The oil passes pressure relief valve 14, which limits the pressure in passage 13 to 100 lbs/in$^2$. The oil flows through port 38 into the block 27, through passage 36 and 32, and past pressure relief valve 43 which limits the pressure to 75 lbs/in$^2$. The oil flow through line 46, header 51, pipes 52 to header 53. The oil then returns through line 47 to passage 33 of the block 27, through port 39 to passage 20 in the engine and to lubricating passage 19.

The pressure relief valve 58 limits the pressure of the oil entering passage 20 to 40 lbs/in$^2$, the standard operating pressure of the lubricating system. The pressure relief valves 14 and 43 permit a high pressure to be applied to the input side of the radiator 48, so that the cold viscous oil problems of prior external radiator devices are obviated. Yet the oil supply to the lubricating passage 19 is at the rated pressure. This arrangement requires that a small portion of the oil flow passes through the valve 58 to the sump after undergoing cooling in the radiator. This flow to the sump is not detrimental since the existing pump 11 has a pumping capacity approximately five times the volume of oil required for effective lubrication.

Thus with the provision of a novel pressure relief block and an external radiator, and a unique and ingenious arrangement of pressure relief valves, the present invention provides a modified and improved lubrication system for internal combustion engines which increases the oil cooling capacity to support high sustained engine power output levels. Further, the invention may be installed with simple tools without extensive alterations to the existing engine.

I claim:

1. An improved lubricating cooling system for an engine including a source of pressurized oil and a sump, wherein the improvement comprises: a heat exchanger disposed externally to the engine and provided with an input side connected to the source of pressurized oil and an output side, first pressure relief valve means connected between said input side and said output side of the heat exchanger for bypassing said heat exchanger only at oil pressures above a first fixed value, a supply line connecting said output side of said heat exchanger and the downstream side of said valve means to the lubricating points of the engine, and second pressure relief valve means connected between and heat exchanger output side and the oil sump for bypassing the lubricating points of the engine only at pressures above a second fixed value.

2. The system of claim 1, including separate passage means directly connecting the input side of said heat exchanger with the lubricating points of the engine and the sump, and blocking means in said passage means for normally preventing the flow of oil through said passage means at least at pressures below and at pressures substantially higher than said first and second fixed values.

3. The system of claim 2, wherein said blocking means is a third pressure relief valve means having two stages, with the first stage passing oil directly to the lubricating points of the engine and blocking the direct passage of oil to the sump only at oil pressures substantially higher than said first and second fixed values and lower than a third fixed value, and further directly passing oil to the lubricating points of the engine and the sump at oil pressures substantially higher than said third fixed value.

4. The system of claim 3, wherein said first fixed value is substantially higher than said second fixed value.

5. The system of claim 4, wherein said heat exchanger is secured with releasable fastening means to the engine and is disposed subjacent to sump plate of the engine.

6. The system of claim 5, including an oil conduit fluid connected between the sump plate drain fitting of the engine and the output side of said heat exchanger substantially completely externally of the engine and having therein said second pressure relief valve means.

7. The system of claim 1, wherein said first fixed value is substantially higher than said second fixed value.

8. The system of claim 2, wherein said first fixed value is substantially higher than said second fixed value.

* * * * *